US007914336B2

(12) United States Patent
Chen et al.

(10) Patent No.: US 7,914,336 B2
(45) Date of Patent: Mar. 29, 2011

(54) WIRING PROCESS AND WIRING ASSEMBLY OF CABLE CONNECTOR

(75) Inventors: Chun-Hsu Chen, Chung Ho (TW); Chun-Hua Chen, Chung Ho (TW)

(73) Assignee: Jess-Link Products Co., Ltd., Taipei County (TW)

( * ) Notice: Subject to any disclaimer, the term of this patent is extended or adjusted under 35 U.S.C. 154(b) by 0 days.

(21) Appl. No.: 12/777,341

(22) Filed: May 11, 2010

(65) Prior Publication Data

US 2010/0304616 A1 Dec. 2, 2010

(30) Foreign Application Priority Data

May 27, 2009 (TW) ..... 98117616 A

(51) Int. Cl.
*H01R 24/00* (2011.01)
*H01R 33/00* (2006.01)

(52) U.S. Cl. ..... 439/660

(58) Field of Classification Search ..... 439/660, 439/76.1, 449–453, 455
See application file for complete search history.

(56) References Cited

U.S. PATENT DOCUMENTS 7,163,408 B1 * 1/2007 Chen et al. ..... 439/76.1
* cited by examiner

*Primary Examiner* — Javaid Nasri
(74) *Attorney, Agent, or Firm* — Chun-Ming Shih; HDLS IPR Services

(57) ABSTRACT

A wiring process of a cable connector includes the steps of: providing a cable and a wiring assembly for the cable connector, the wiring assembly having a wiring body and a wiring plate; inserting naked ends of each cable core extending from the distal end of the cable into wiring ports of the wiring plate separately; and assembling the wiring plate with the wiring body to form the wiring assembly, thereby completing the wiring process.

5 Claims, 6 Drawing Sheets

WIRING PROCESS AND WIRING ASSEMBLY OF CABLE CONNECTOR

BACKGROUND OF THE INVENTION

1. Field of the Invention

The present invention relates to a connector, and in particular to a wiring process and a wiring assembly of a cable connector.

2. Description of Prior Art

As shown in FIG. 1, in a conventional cable connector, an insulating body 1*a* and a cable 3*a* are connected via a wiring assembly 2*a* by putting naked ends 300*a* of cable cores 30*a* in the cable 3*a* separately at corresponding positions of the insulating body 1*a*. In this way, a soldering process or electrical connection can be performed easily. Further, some cable cores 30*a* may comprise two or more wires 31*a*, 32*a* and 33*a* that are covered by an insulating layer separately. The wiring assembly 2*a* is provided with a plurality of troughs 20*a* for allowing the wires 31*a*, 32*a* and 33*a* of each cable core 30*a* to be embedded therein. Thus, the short circuit caused by the possible contact of the naked ends 300*a* can be prevented.

However, in such a wiring assembly 2*a* of the cable connector, the trough 20*a* is not provided with any distinguishable or recognizable shape or indicator. As a result, when an operator intends to embed the naked ends 300*a* of each cable core 300*a* into the troughs 20*a*, the operator may make mistake because he/she get confused by a great amount of naked ends 300*a*. Thus, the operator may embed some naked end 300*a* into a wrong trough 20*a* easily, which makes the wiring procedure difficult and incorrect. Further, since the naked ends 300*a* have a certain length, it is difficult for the operator to embed all the naked ends 300*a* into the wiring assembly 2*a* in one time.

SUMMARY OF THE INVENTION

The present invention is to provide a wiring process and a wiring assembly of a cable connector. Due to its improved structure, the operator can disposed respective naked ends of the cable in correct positions separately. It is not necessary for the operator to embed all the naked ends into the wiring assembly in one time. Thus, the mistake made in performing the wiring process can be reduced and the assembling process can be performed more easily and correctly.

The present invention is to provide a wiring process of a cable connector, which includes the steps of:

a) providing a cable, a wiring body and a wiring plate, wherein the wiring body and the wiring plate are in a separate status;

b) embedding naked ends of cable into wiring ports of the wiring plate separately; and c) assembling the wiring plate with the wiring body to form a single assembly.

The present invention is to provide a wiring assembly of a cable connector, which includes a wiring plate and a wiring body. The upper and lower edges of the wiring plate are provided with a plurality of wiring ports. The wiring body is assembled with the wiring plate. A detachable mechanism is provided between the wiring plate and the wiring body, so that the front end face of the wiring plate can be overlapped on the rear end face of the wiring body to form a single unit. By this arrangement, the wiring assembly of a cable connector can be obtained.

DETAILED DESCRIPTION OF THE INVENTION

Figure 1:
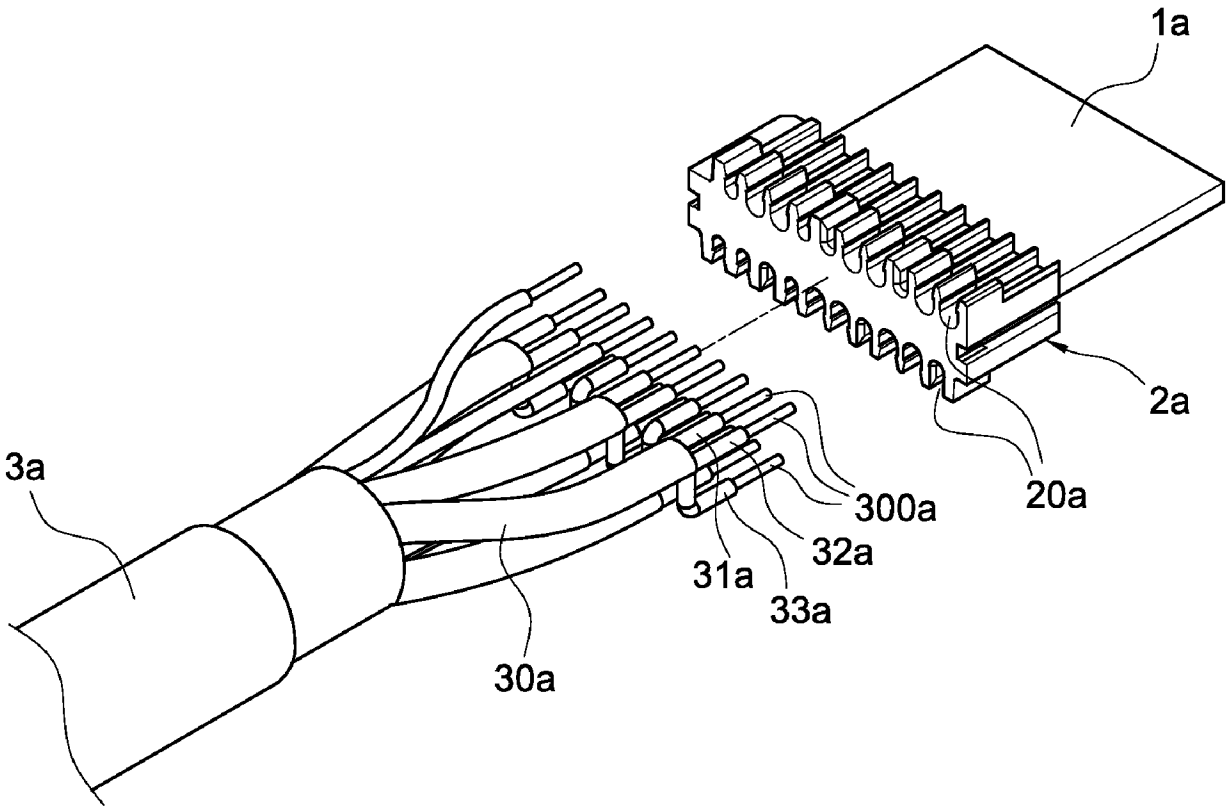
FIG.1 (Prior Art)
FIG. 1 is an exploded view showing the wiring assembly of the cable connector in prior art.

In order to make the Examiner better understand the characteristics and technical contents of the present invention, a description relating thereto will be explained with reference to the accompanying drawings. However, the drawings are illustrative only but not used to limit the present invention.

The present invention provides a wiring process and a wiring assembly of a cable connector. Please refer to the step S1 in FIG. 2 and also refer to FIG. 3. First, a cable 3 and a wiring assembly 2 of a cable connector are provided. The wiring assembly 2 comprises a wiring body 21 and a wiring plate 20 that are detachably assembled with each other. The cable connector further includes a connecting head 1. The connecting head 1 comprises a casing 10 and an insulating body 11 provided in the casing 10. The insulating body 11 is connected to the wiring body 21 of the wiring assembly 2, so that all these components can be assembled in the casing 10. Further, a detachable mechanism 22 is provided between the wiring plate 20 and the wiring body 21 of the wiring assembly 2. The detachable mechanism 22 is composed of two insertion holes 220 on the front end face of the wiring plate 20 and two corresponding insertion pins 221 on the rear end surface of the wiring body 21. After the insertion pins 221 insert into the insertion holes 220, the front end face of the wiring plate 20 touches the rear end face of the wiring body 21, thereby forming a detachable assembly. By means of the detachable assembly, the wiring plate 20 can dovetail with the wiring body 21. Of course, the positions of the insertion holes 220 and the insertion pins 221 can be exchanged.

Figure 2:
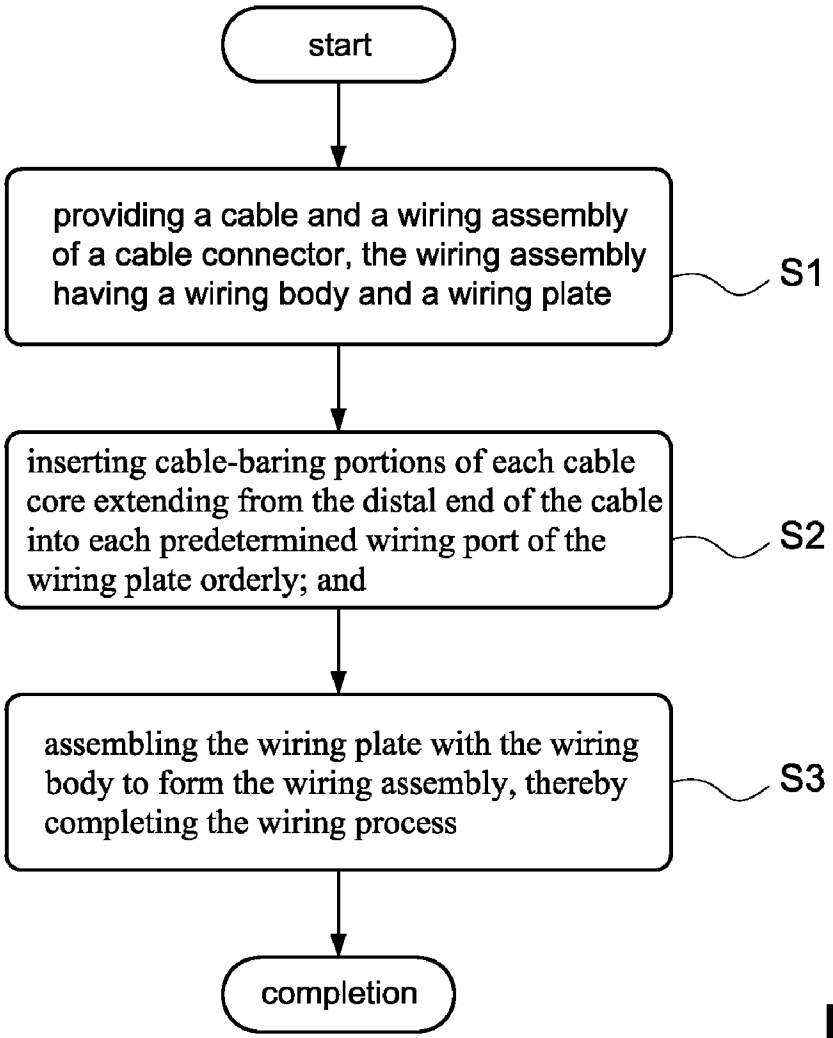
FIG. 2 is a flow chart showing the steps of the present invention.
Figure 3:
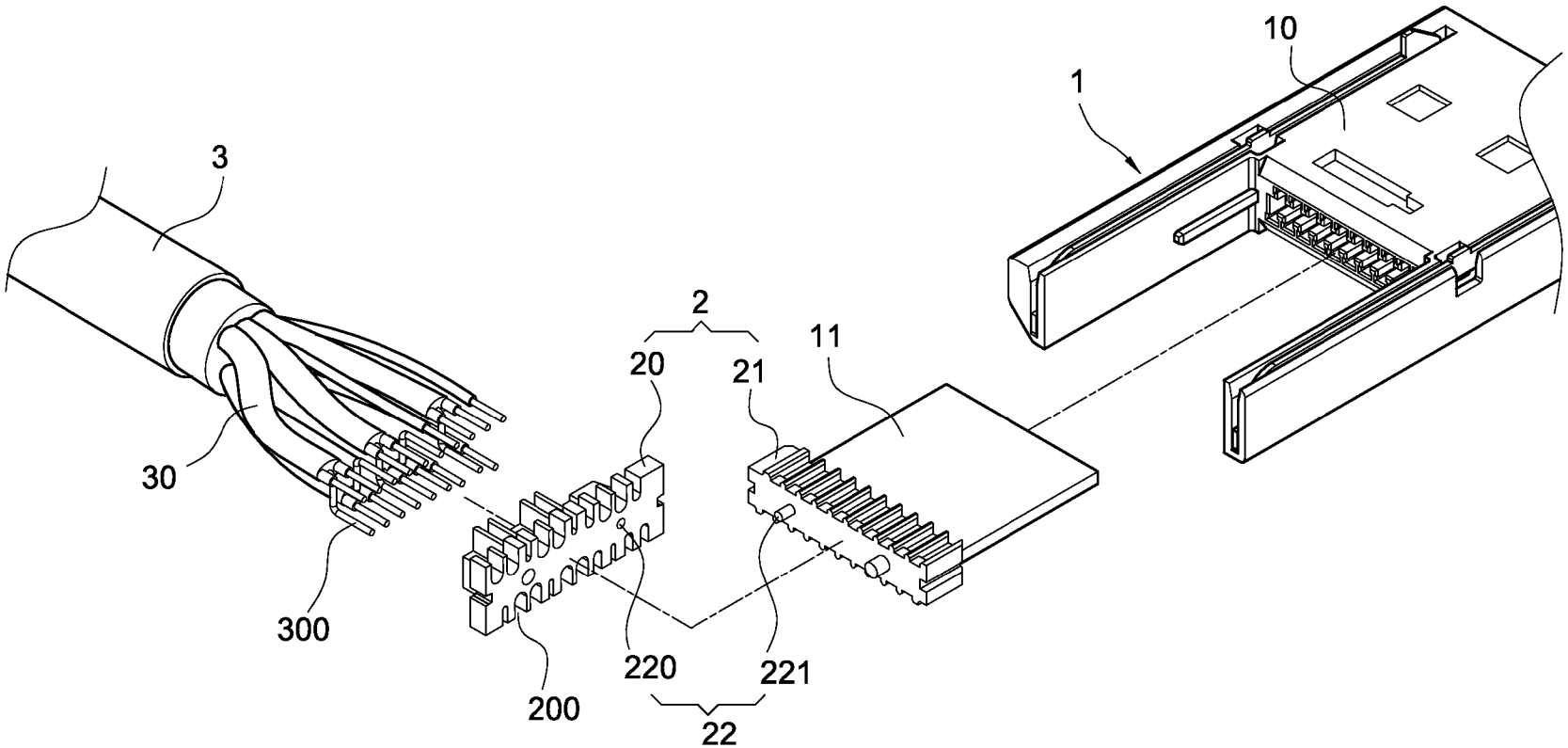
FIG. 3 is an exploded perspective view showing the cable connector of the present invention.
Figure 4:
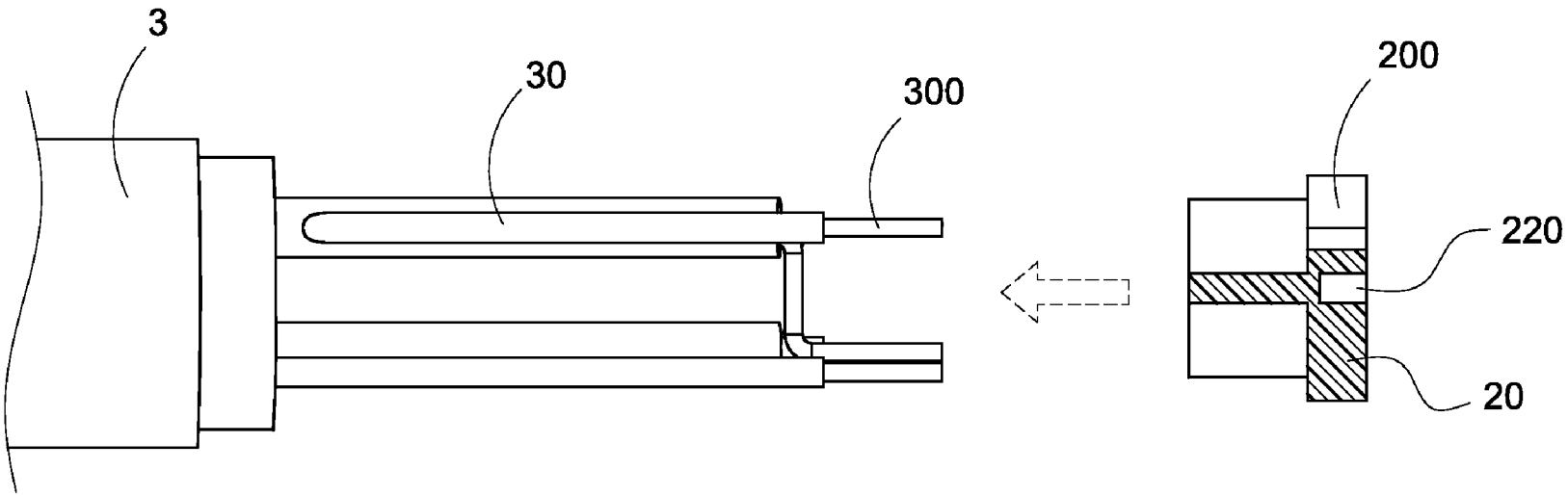
FIG. 4 is a schematic view showing the action in the step S2 of FIG. 2.

Next, please refer to the step S2 in FIG. 2 and also refer to FIG. 4. Naked ends 300 of each cable core 30 of the cable 3 are separately embedded into wiring ports 200 provided on the upper and lower edges of the wiring plate 20. Thus, the operator can make the originally-disordered cable cores 30 in order.

Figure 5:
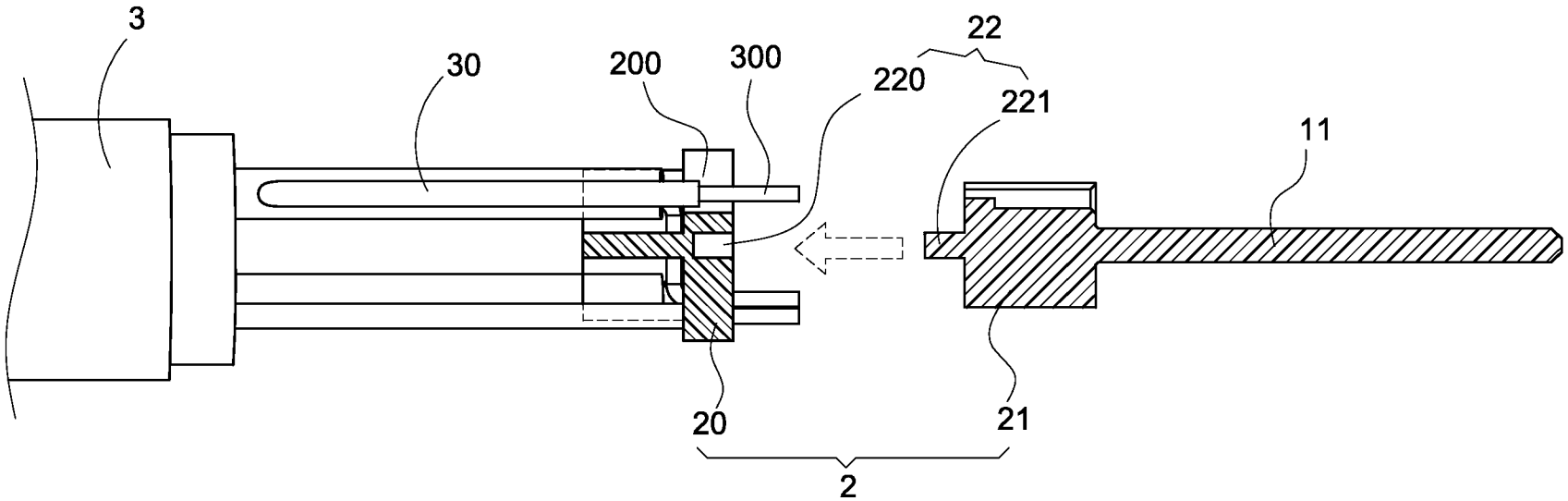
FIG. 5 is a schematic view showing the action in the step S3 of FIG. 2.
Figure 6:
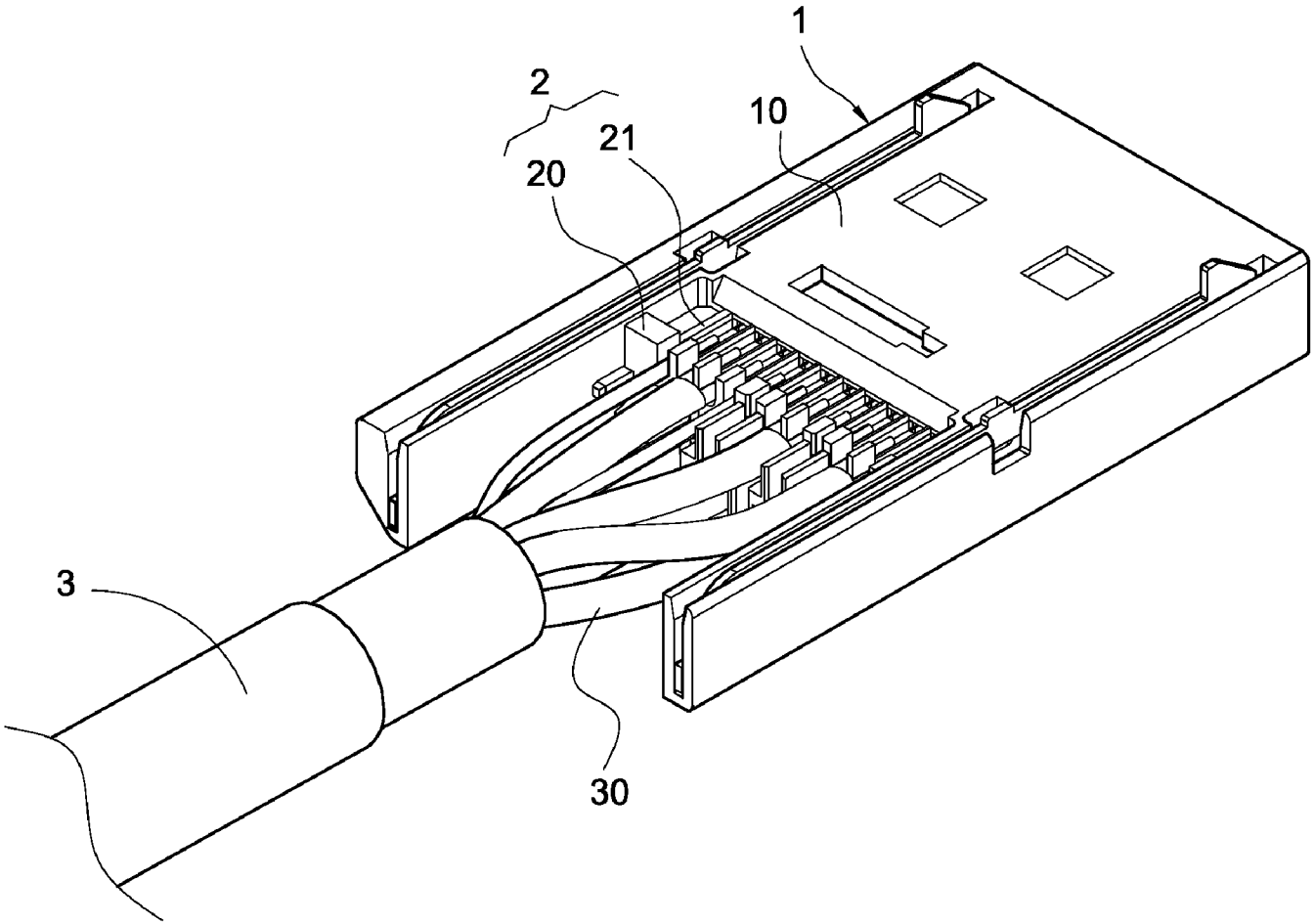
FIG. 6 is an assembled perspective view showing the cable connector of the present invention.

Please refer to the step S3 in FIG. 2 and also refer to FIG. 5. The wiring plate 20 is assembled with the wiring body 21 to form the wiring assembly 2. That is, via the detachable mechanism 22 between the wiring plate 20 and the wiring body 21, the wiring plate 20 can be assembled on the rear end face of the wiring body 21. Since the respective cable cores 30 of the cable 3 are put in order after the step S2, the length of each naked end 300 is partially embedded into the wiring plate 20. As a result, the remaining part of each naked end 300 can be disposed on the wiring body 21 more easily and correctly. Thus, the wiring process can be completed. Then, the terminals in the casing 10 can be soldered to generate electrical connection (FIG. 6).

Via the above arrangement, the wiring process and the wiring assembly of a cable connector according to the present invention can be obtained.

According to the above, the present invention really achieves the expected objects and solves the problems of prior art. Further, the present invention demonstrates novelty and inventive steps, which conforms to the requirements for an invention patent.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A wiring process of a cable connector, comprising the steps of:

a1) providing a cable having a plurality of cable cores, each cable core including a plurality of wires and each wire being covered by an insulating layer and a naked end extending out of the insulating layer;

a2) providing a connecting head having a casing and an insulating body provided inside the casing and a wiring body connected to the insulating body;

a3) providing a wiring plate, wherein the wiring body and the wiring plate are in a separate status;

b) embedding naked ends of the cable into wiring ports of the wiring plate respectively; and c) assembling the wiring plate with the wiring body through a detachable mechanism to form a single assembly.

2. The wiring process of a cable connector according to claim 1, wherein the wiring plate is detachably assembled with the wiring body through the detachable mechanism.

3. The wiring process of a cable connector according to claim 2, wherein the wiring plate is provided with insertion holes, the wiring body is provided with corresponding insertion pins, the insertion pins are inserted into the insertion hole to form the detachable mechanism.

4. A wiring assembly of a cable connector, comprising;

a cable having a plurality of cable cores, each cable core including a plurality of wires and each wire being covered by an insulating layer and a naked end extending out of the insulating layer;

a connecting head having a casing and an insulating body provided inside the casing;

a wiring body connected to the insulating body; and a wiring plate with its upper and lower edges provided with a plurality of wiring ports for receiving naked ends of the cable respectively;

wherein a detachable mechanism is provided between the wiring plate and the wiring body, so that the wiring plate is combined with the wiring body to form a single unit.

5. The wiring assembly of a cable connector according to claim 4, wherein the detachable mechanism comprises insertion holes on a front end face of the wiring plate and corresponding insertion pins on a rear end face of the wiring body.

* * * * *